US009937983B1

(12) United States Patent
Duke et al.

(10) Patent No.: US 9,937,983 B1
(45) Date of Patent: Apr. 10, 2018

(54) PONTOON BOAT HAVING AN OCCUPANCY COMPARTMENT

(71) Applicant: Brunswick Corporation, Lake Forest, IL (US)

(72) Inventors: Corey G. Duke, Knoxville, TN (US); Robert A. Fieldhouse, Fort Wayne, IN (US); Donald F. Mason, Jr., Fort Wayne, IN (US); Rachel Parteko, Ossian, IN (US); Matthew R. Gardenour, Fort Wayne, IN (US); Gary W. Rose, Roanoke, IN (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/420,561

(22) Filed: Jan. 31, 2017

Related U.S. Application Data

(60) Provisional application No. 62/292,480, filed on Feb. 8, 2016.

(51) Int. Cl.

| | |
|---|---|
| ***B63B 29/14*** | (2006.01) |
| ***B63B 35/00*** | (2006.01) |
| ***B63B 1/12*** | (2006.01) |
| ***B63B 35/38*** | (2006.01) |

(52) U.S. Cl.
CPC ..... *B63B 29/14* (2013.01); *B63B 1/125* (2013.01); *B63B 35/38* (2013.01); *B63B 2705/00* (2013.01); *B63B 2707/00* (2013.01)

(58) Field of Classification Search
CPC B63B 1/121; B63B 1/12; B63B 1/125; B63B 3/48; B63B 35/00; B63B 35/34
USPC ..... 114/61.1, 283, 292
See application file for complete search history.

(56) References Cited

U.S. PATENT DOCUMENTS

| | | | | |
|---|---|---|---|---|
| 3,614,937 | A * | 10/1971 | Schulman | B63B 1/121 114/283 |
| 4,109,604 | A * | 8/1978 | Reed | B63B 29/16 114/125 |
| 4,989,535 | A | 2/1991 | Lacasse et al. | |
| 5,029,348 | A | 7/1991 | Boren | |
| 5,086,725 | A | 2/1992 | Garrett et al. | |
| 5,435,260 | A * | 7/1995 | Granie | B63B 1/12 114/290 |
| 7,263,945 | B2 * | 9/2007 | Little | B63B 17/02 114/292 |
| 9,475,548 | B1 * | 10/2016 | Slocum | B63B 1/125 |

* cited by examiner

*Primary Examiner* — Lars A Olson
(74) *Attorney, Agent, or Firm* — Andrus Intellectual Property Law, LLP

(57) ABSTRACT

A pontoon boat includes at least two pontoon tubes, a platform supported on the at least two pontoon tubes, and an occupancy compartment capable of containing at least one occupant, the occupancy compartment having a length, a width, an upper portion extending vertically above the platform that includes a ceiling, and a lower portion extending vertically below the platform and into one of the at least two pontoon tubes, the lower portion including a floor surface for supporting the occupant. An entrance to the occupancy compartment is provided in the upper portion that permits the occupant to enter and exit the occupancy compartment.

20 Claims, 10 Drawing Sheets

PONTOON BOAT HAVING AN OCCUPANCY COMPARTMENT

CROSS-REFERENCE TO RELATED APPLICATION

The present application is based on and claims priority to U.S. Provisional Patent Application Ser. No. 62/292,480 filed Feb. 8, 2016, the disclosure of which is incorporated herein by reference.

BACKGROUND

U.S. Pat. No. 3,614,937 discloses a plurality of modular pontoon float sections of uniform cross sectional dimension supported in longitudinal alignment with each other along two parallel sides of a pontoon boat deck through the instrumentality of a pair of longitudinally extending parallel flanges extending upwardly from each of the float sections to snugly receive one of a pair of parallel downwardly extending deck floor joists. Transverse aligned openings are provided in the flanges and in the joists to receive bolts for releasably fastening the pontoons to the deck. Pontoon sections at a front end of each aligned set can have a sloping shape to facilitate movement of the boat through the water. The openings in the pontoon flanges or in the deck joists can be slots which will permit removal of the pontoons from the joists after the bolts are loosened but without the necessity of completely removing the bolts. Such a pontoon structure can be semipermanently moored to a pier or the shore to form part or all of a dock, wharf, or bridge. It can be lengthened by adding additional float sections to a longer deck or floor.

U.S. Pat. No. 4,989,535 discloses a combination steering console and refreshment center for a pontoon boat. The console includes a first face on which a steering wheel is mounted and a second opposed face. The upper portion of the second face is provided with an opening that is enclosed by a hinged cover which is movable from a closed position to a generally horizontal open position. A horizontal serving counter is disposed in the housing and is formed with a plurality of wells; one of the wells can constitute a sink, a second well can constitute a cooler and the third well can serve as a bottle rack. A generally vertical backsplash extends upwardly from the rear edge of the counter and a removable, flexible curtain joins the backsplash with the upper wall of the console. By disengaging the curtain, access can be had to equipment located behind the first face of the console.

U.S. Pat. No. 5,029,348 discloses a head construction for a pontoon boat comprising a housing having an open top and an open front and a toilet is mounted within the housing. A lid is hinged to the rear edge of the housing and is movable between a horizontal, closed position and an open position where the lid extends vertically. A foldable frame is secured to the housing and can be moved between a folded retracted position, where the frame is located within the housing, to an extended position where the frame extends vertically a substantial distance above the housing. A flexible curtain interconnects the undersurface of the lid and the frame and the lower end portion of the curtain is disposed within the open front end of the housing. When the lid is moved to the open position, the frame can be pivoted from the retracted to the extended position where the curtain provides an enclosure. The front surface of the curtain is provided with a closable slit to enable a person to enter the enclosure which provides complete privacy for a person using the head.

U.S. Pat. No. 5,086,725 discloses a recreational boat construction utilizing a hull formed of a thin gauge metal, such as aluminum, with the hull having an upper extremity to which are fastened unitary superstructure members molded from a plastic resin. The superstructure panels are rigidly fastened to the upper extremity of the hull and to the deck.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of a pontoon boat includes at least two pontoon tubes, a platform supported on the at least two pontoon tubes, and an occupancy compartment capable of containing at least one occupant, the occupancy compartment having a length, a width, an upper portion extending vertically above the platform that includes a ceiling, and a lower portion extending vertically below the platform and into one of the at least two pontoon tubes, the lower portion including a floor surface for supporting the occupant. An entrance to the occupancy compartment is provided in the upper portion that permits the occupant to enter and exit the occupancy compartment.

One embodiment of an occupancy compartment in a pontoon of a pontoon boat has an upper portion extending vertically above a platform of the pontoon boat, the upper portion including a ceiling, and a lower portion extending vertically below the platform and into the pontoon tube of the pontoon boat, the lower portion including a floor surface. A metal cavity connecting the occupancy compartment within the pontoon tube, wherein the metal cavity is positioned within a hollow of the pontoon tube to create a sealed cavity surrounding at least some of the lower portion. A liner fits within the metal cavity to form the lower portion of the occupancy compartment. An entrance is provided in the upper portion that permits entrance and exit of an occupant to the occupancy compartment.

BRIEF DESCRIPTION OF THE DRAWINGS

The present disclosure is described with reference to the following Figures.

DETAILED DESCRIPTION OF THE DRAWINGS

Through research and assessment of the relevant field of pontoon boats, the present inventors recognized that there is a need within the pontoon boating industry for a pontoon boat with a fully enclosed compartment that can be used for occupancy space, such as for a private changing space or for a bathroom. Presently available pontoon boat designs offering changing or bathroom facilities only provide partially enclosed areas that are above deck, or the platform of the pontoon boat, and open to the outdoors. These available designs limit privacy and the ability to get out of weather conditions. Furthermore, presently available pontoons do not offer bathroom facilities with running water, such as a flushing toilet, a sink, and/or shower.

In accordance with their research and recognition of need within the pontoon industry, the present inventors developed a pontoon boat 1 with an occupancy compartment 11 that utilizes the hollow space within one of the pontoon tubes for occupancy space without impacting the buoyancy of the vessel. The step-down design provides more privacy than the above-deck, open air designs presently available in the pontoon boat industry. Additionally, utilization of the hollow space within the pontoon tube allows for a sleeker and more compact vessel design.

Figure 1:
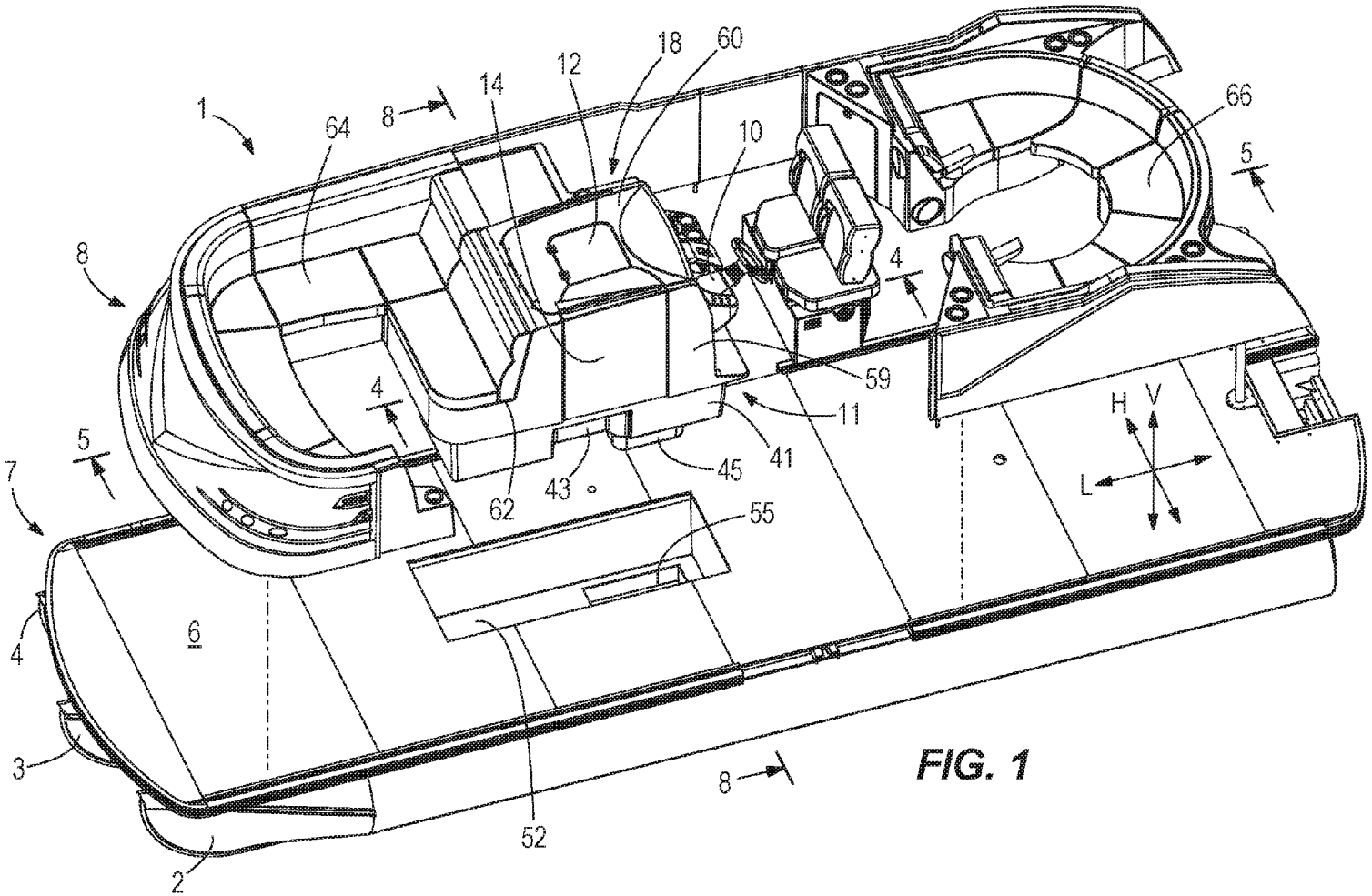
FIG. 1 is an exploded perspective view of one embodiment of a pontoon boat having an occupancy compartment wherein the upper structure of the pontoon boat is shown removed from the lower structure.

FIG. 1 depicts a pontoon boat 1 having a platform 6 on three pontoons 2-4. The pontoon boat 1 is shown with its front-to-back length oriented along longitudinal axis L, its port-to-starboard width oriented along horizontal axis H, and its height oriented along vertical axis V (see FIGS. 1 and 4). FIG. 1 depicts the upper structure 8 separated from the lower structure 7. The lower structure 7 includes the platform 6 supported on the pontoon tubes, including the port pontoon tube 2, the center pontoon tube 3, and the starboard pontoon tube 4. Other embodiments may include any number of two or more pontoon tubes 11. The length of the pontoon tubes are oriented along the longitudinal axis L, and the pontoon tubes are separated with respect to the horizontal axis H in order to provide stability to the platform 6. The pontoon tubes 11 are generally hollow structures, such as hollow structures comprised of metal, as is typical in the relevant art. The hollow pontoon tubes 11 may be generally cylindrical in shape, as shown in the depicted embodiment, or may take on other shapes (various examples of which are depicted in U.S. Pat. Nos. 3,614,937 and 5,086,725 incorporated herein by reference).

The upper structure 8 includes a front seating area 64, a rear seating area 66, and a helm 10. Shown with the upper structure 8 is an occupancy compartment 11 that fits into a cavity 52 in the lower structure 7. In the depicted embodiment, the cavity 52 is shown as extending into the center pontoon tube 3. However, in other embodiments, the cavity 52 may extend into either of the port side pontoon tube 2 or the starboard side pontoon tube 4. The depicted embodiment has an occupancy compartment 11 with an upper portion 59 that extends above the platform 6, and a lower portion 41 that extends below the platform 6 and down into the center pontoon tube 3. Accordingly, in the depicted embodiment the occupancy compartment 11 is situated in the lateral middle of the pontoon boat 1 above the center pontoon tube 3. In other embodiments, the occupancy compartment 11 may be situated above and extend into either of the port pontoon tube 2 or the starboard pontoon tube 4.

Figure 2:
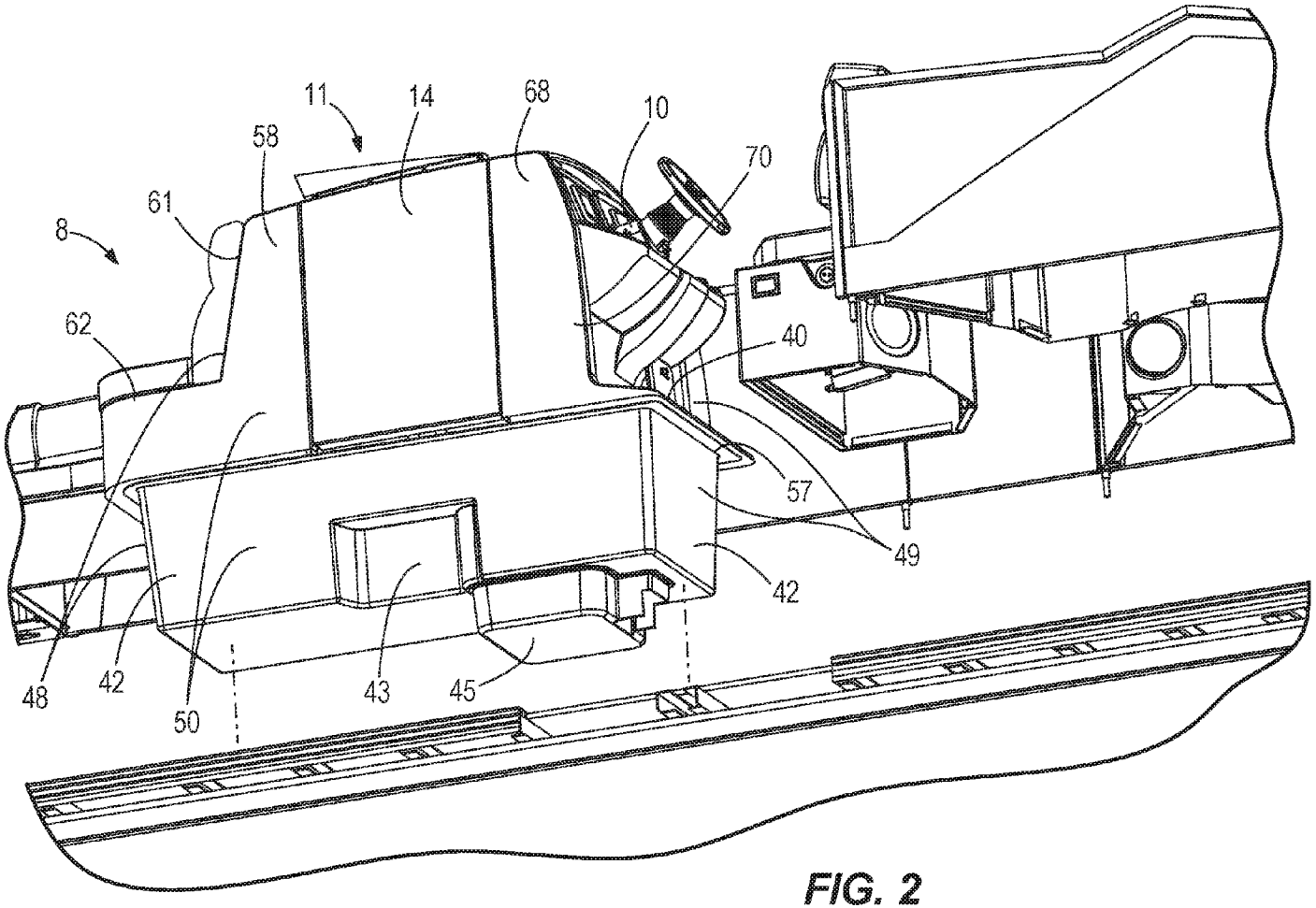
FIG. 2 depicts a bottom perspective view of the upper structure of FIG. 1.
Figure 4:
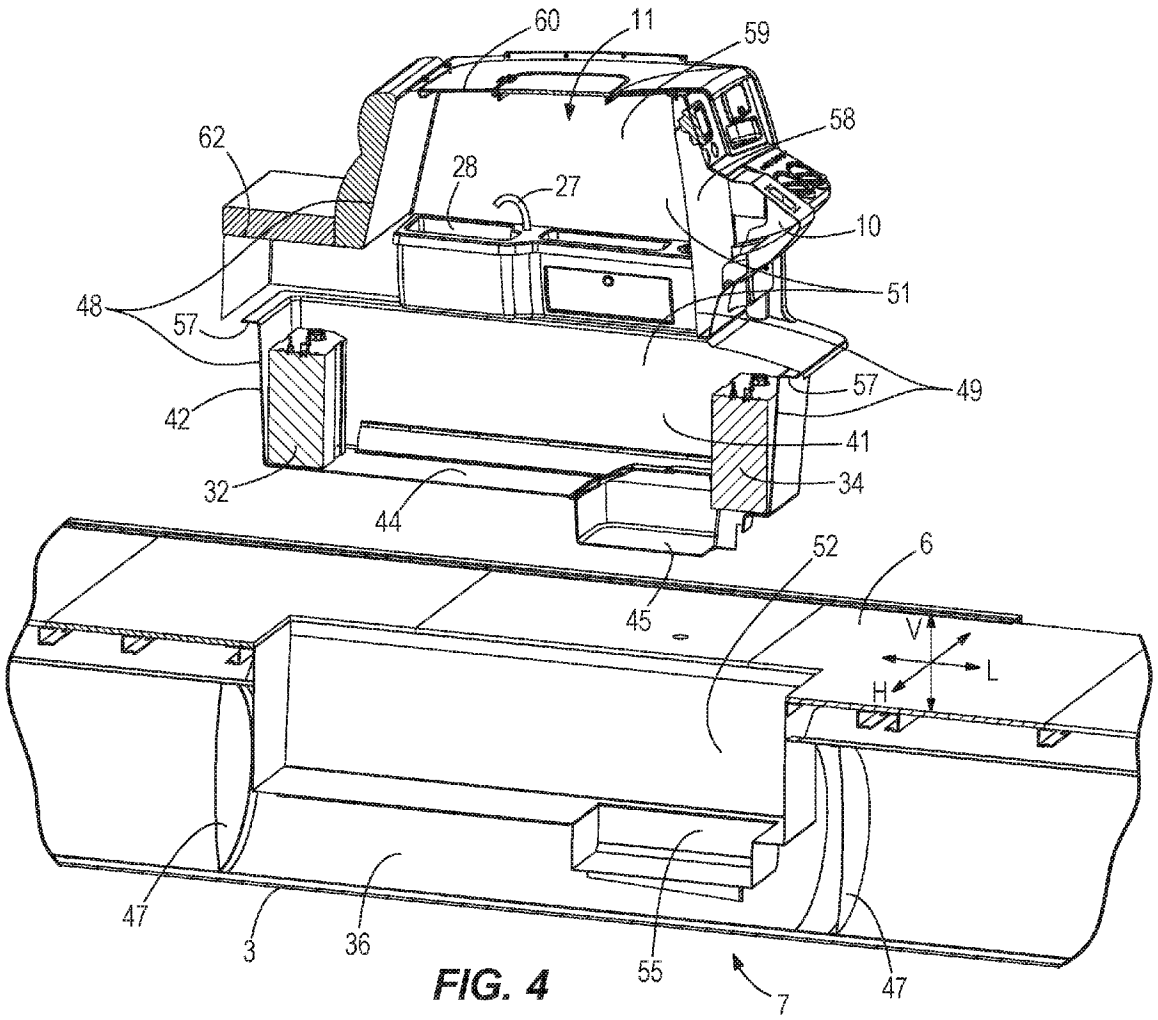
FIG. 4 depicts a cross-sectional view of one embodiment of a pontoon boat having an occupancy compartment, with the upper structure shown separated from the lower structure.

The upper portion 59 and the lower portion 41 form the occupancy compartment 11, including a floor surface 44, a ceiling 60, a front side wall 48, a rear side wall 49, a port side wall 50, and a starboard side wall 51 (see FIGS. 2 and 4). In the depicted embodiment, the upper portion 59 is formed by an upper liner 58 and the lower portion 41 is formed by a lower liner 42. In other embodiments, the occupancy compartment 11 may be formed by a single unitary liner, or by any number of two or more liner pieces divided in any way.

The occupancy compartment 11 has an entrance above the platform 6 that is a hinged door 14 on the port side of the upper portion 59 of the occupancy compartment 11. In other embodiments, the entrance may include a different door or divider, or may be an open entrance; and in various embodiments the entrance may be provided on any wall 48-51 of the occupancy compartment 11. The upper portion 59 also has a hatch 12, which is in the ceiling 60 and is openable to allow ventilation in the occupancy compartment 11 when the door 14 is closed and also to permit extension of the vertical height of the occupancy compartment 11. In certain embodiments, the ceiling 60 and or the hatch 12 may be comprised of a semi-transparent or transparent material that allows natural light to enter the occupancy compartment 11, which eliminates the need for artificial lighting during daylight.

Figure 5:
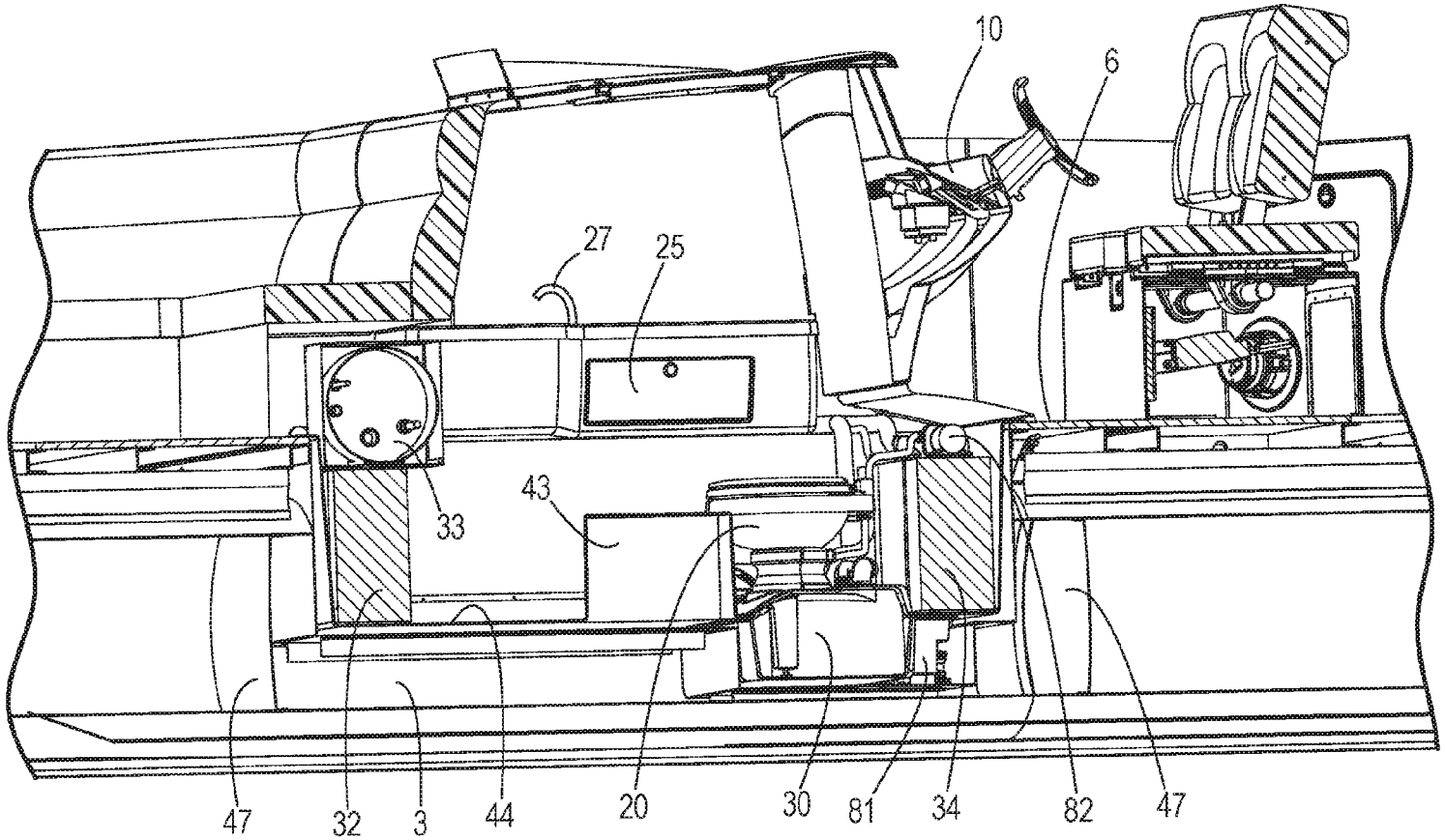
FIG. 5 depicts another cross-sectional view of the embodiment of FIG. 4 with the upper structure assembled to the lower structure.
Figure 6:
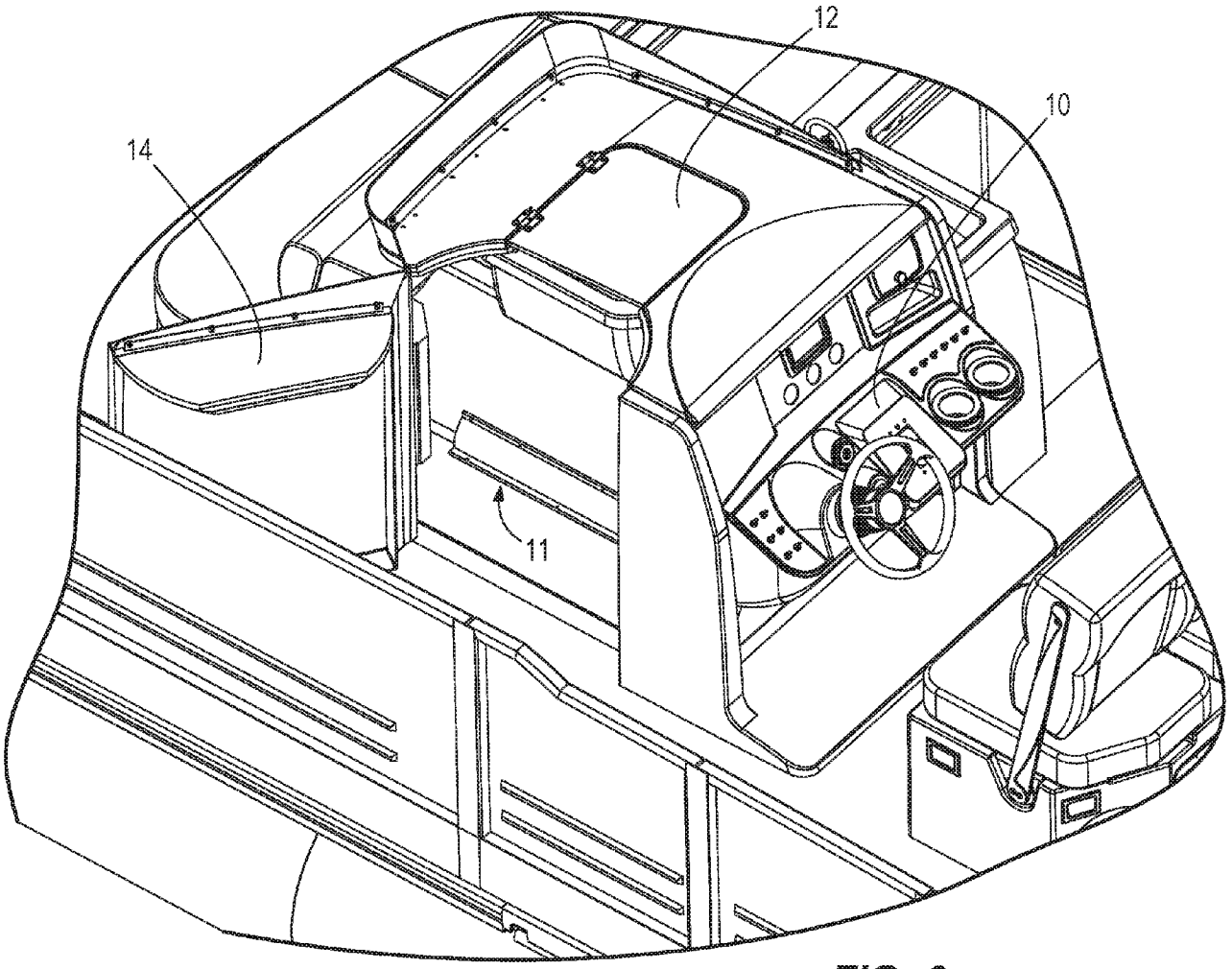
FIG. 6 depicts an embodiment of a pontoon boat having an occupancy compartment.
Figure 7:
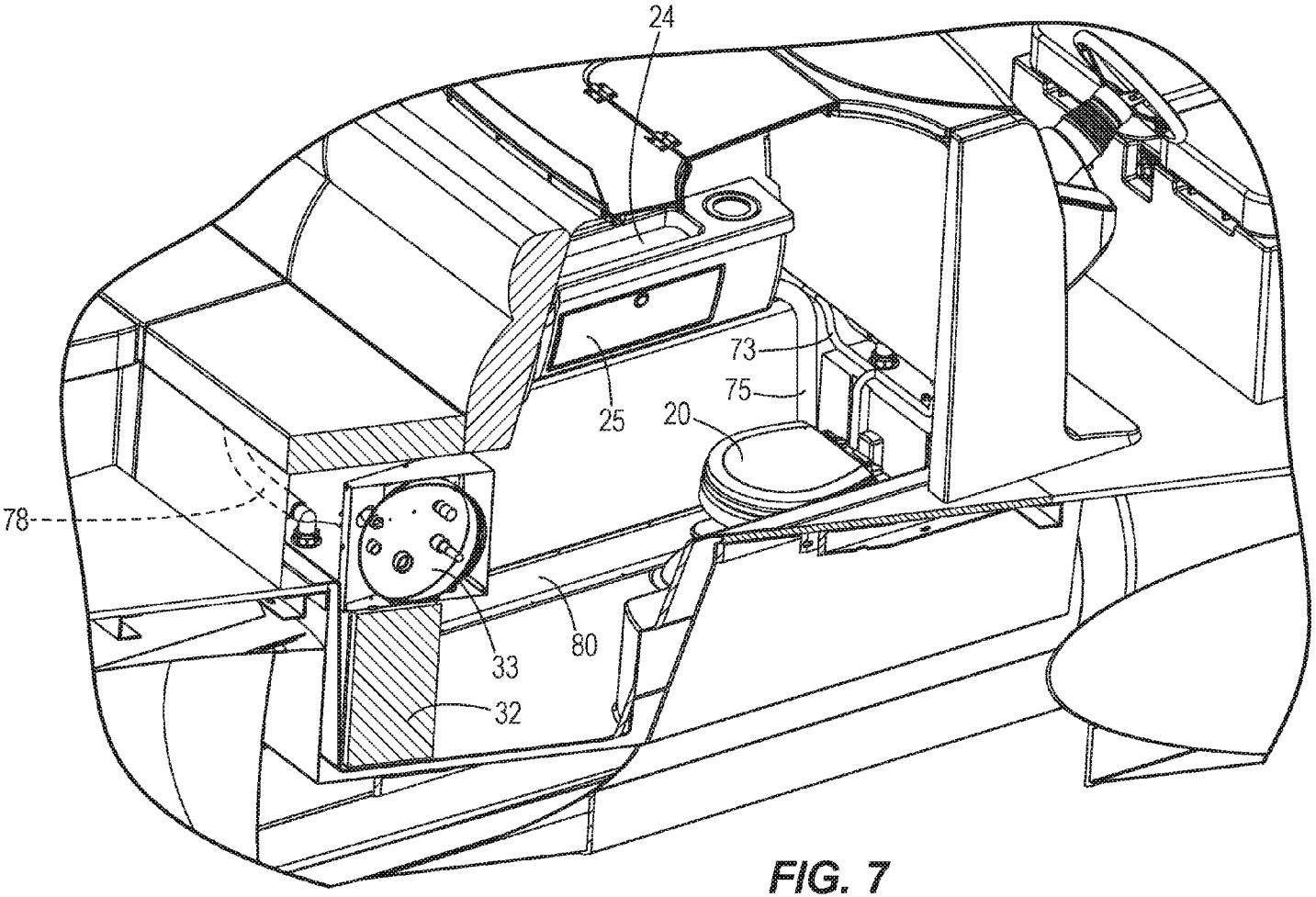
FIG. 7 depicts a cutaway view of the embodiment depicted in FIG. 6.
Figure 8:
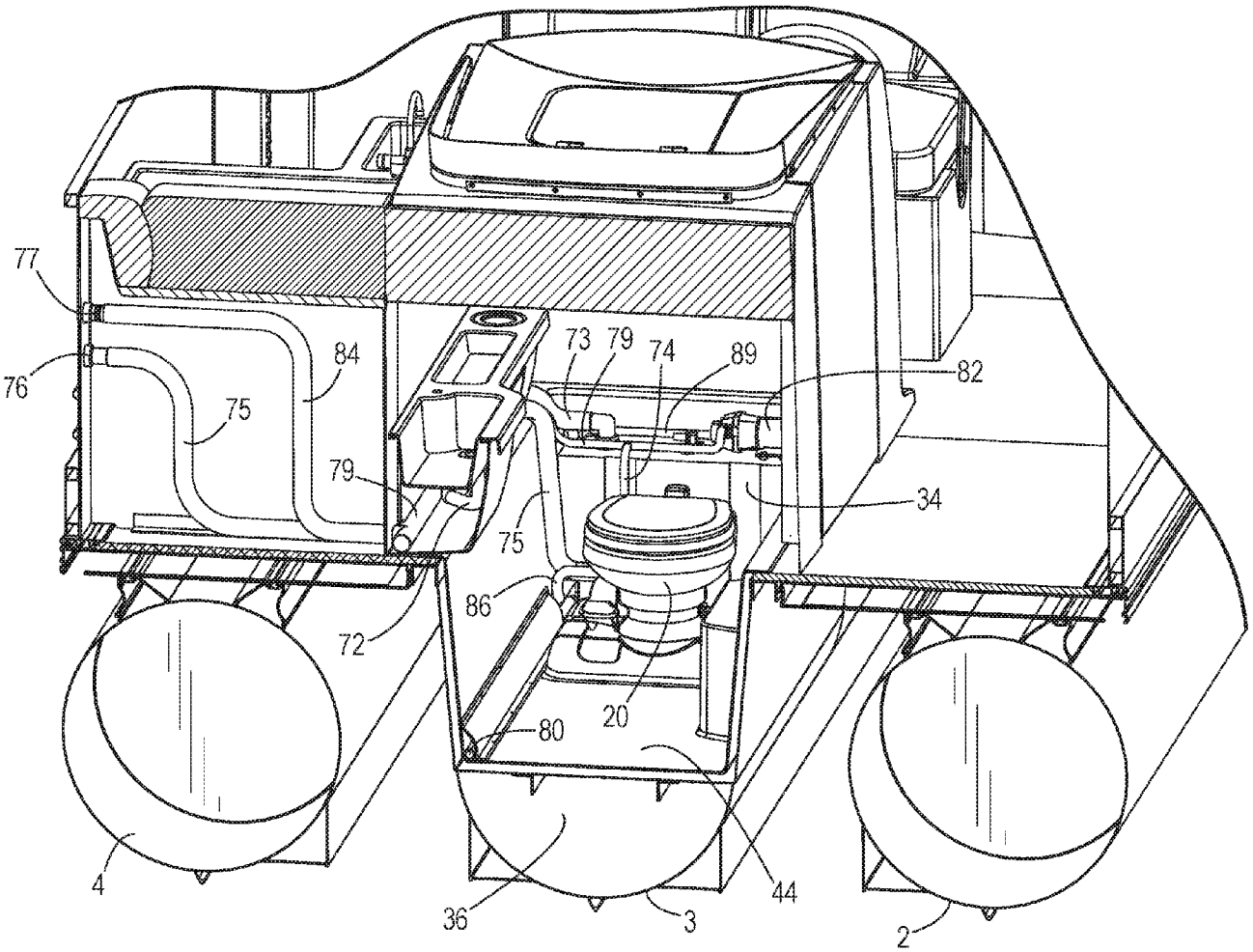
FIG. 8 depicts a cross-sectional view of the embodiment of FIGS. 6 and 7.

FIG. 2 depicts a lower perspective view of the upper structure 8 of the pontoon boat 1. The occupancy compartment 11 is formed by a lower liner 42 and an upper liner 58 which connect together at joint 40. The lower liner 42 includes a step 43 formed therein that provides a surface upon which the user can step when transitioning into or out of the occupancy compartment 11. The lower liner 42 also provides a floor surface 44 (see FIGS. 4-5 and 7-8) for the occupancy compartment 11, and the step 43 provides a surface between the floor surface 44 and the platform 6 for ease of entrance and exit. In other embodiments, two or three steps may be provided or the step 43 may be omitted. The upper liner 58 has the hinged door 14 on the port side 68. FIG. 6 depicts a similar embodiment with the hinged door 14 in an open position providing entry access to the occupancy compartment 11. The exterior front side 61 of the upper liner 58 forms a seat 62 that is part of the front seating area 64. The exterior rear side 70 of the upper liner 58 provides the mounting surface for the helm 10 of the pontoon boat 1.

Figure 3:
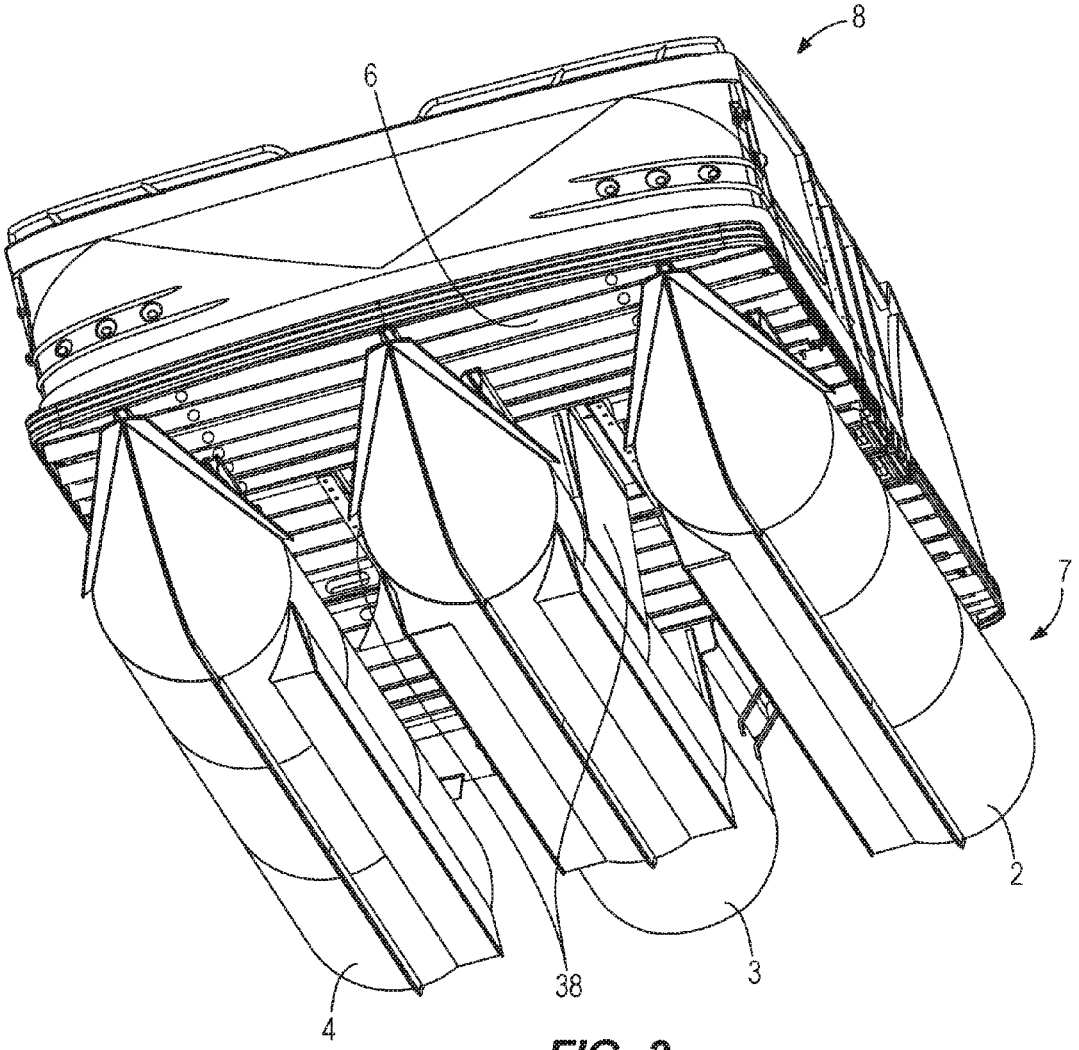
FIG. 3 depicts a bottom perspective view of the lower structure of the pontoon boat of FIG. 1.

As shown in FIG. 3, the pontoon boat includes three pontoons 2-4 supporting and providing floatation to the platform 6. The occupancy compartment 11 extends into the center pontoon tube 3. One or more brackets 38 provide additional support and connection between the center pontoon tube 3 and the lower side of the platform 6 to provide additional weight bearing support to support the occupancy compartment 11. The brackets 38 are connected on either side of the center pontoon tube 3 at a location proximal to the occupancy compartment 11, such as on either side of the occupancy compartment 11. Thus, efficient and maximum weight bearing support is provided by the brackets 38. In the depicted embodiment, the brackets 38 are formed by metal sheets that extend from either side of the center pontoon 3 and bolt to frame pieces on the underside of the platform 6. In certain embodiments, the brackets 38 may be formed by a continuous metal sheet forming a "U" shape that wraps underneath and supports the pontoon tube 3. In other embodiments, the brackets may be welded to the pontoon 3 or fixed thereto by some other means. In other embodiments, the brackets 38 may be formed as part of or may be connected to the metal cavity 52 which is welded to the pontoon tube 3.

FIG. 4 depicts a cross-sectional view of one embodiment of the occupancy compartment 11 depicted with the lower liner 42 and upper liner 58 separated from the lower structure 7 of the pontoon boat 1. As also shown in FIG. 5, the lower liner 42 fits within a metal cavity 52 in the center pontoon tube 3. The metal cavity 52 supports the occupancy compartment 11 and receives the lower liner 42. The lower liner 42 sits down into the metal cavity 52. The lower liner 42 and/or the upper liner 58 may also have a lip portion 57 that extends onto the platform 6 to support some or all of the weight of the lower liner 42 and/or the upper liner 58, as well as the components contained within the occupancy compartment 11. The metal cavity 52 may have any shape required to provide for an occupancy compartment 11 and associated componentry. In the depicted embodiment, the metal cavity 52 has a lower basin 55 that accommodates a toilet 20 and a waste water tank 30. Correspondingly, the lower liner 42 may have a basin liner portion 45 that lines the lower basin 55 and provides connection to the toilet 20 and/or waste water tank 30 (FIG. 5).

In the depicted embodiment, the metal cavity 52 is welded to the center pontoon tube 3, which is also made of metal. The metal cavity 52 extends only partially into the hollow center pontoon tube 3 such that a sealed cavity 36 surrounds the lower portion 41 of the occupancy compartment 11. Accordingly, the pontoon tube can be utilized for occupancy space without a loss of buoyancy. Dividers 47 may be situated within the hollow of the pontoon tube to further seal off and portion the center pontoon tube 3 to provide additional barriers to prevent water from filling the center pontoon tube 3 should a leak develop, such as through the metal cavity 52 or at the welded joint between the metal cavity 52 and the center pontoon tube 3. In the depicted embodiment, the dividers 47 are metal pieces extending across and closing off a cross section of the hollow within the pontoon tube 3 on either side of the metal cavity 52, thereby confining the sealed cavity 36 to an area immediately around the lower portion 41 of the occupancy compartment 11. In the depicted embodiment, the sealed cavity 36 formed by the dividers 47 occupies an approximate center portion along the length of the pontoon tube 3. In other embodiments, the metal cavity 52 and surrounding sealed cavity 36 may be occupy a forward or rearward portion along the length of the pontoon tube 3, and in such an embodiment a single divider 47 may be utilized to for the sealed cavity 36. In such an embodiment, counter weighting and/or weight balancing may be desirable, as is described below.

In various embodiments, the occupancy compartment may be a private seating or changing area that may contain furniture for sitting or laying. In other embodiments, such as those depicted in FIGS. 4-8, the occupancy compartment 11 may contain a bathroom having at least one of a toilet, a sink, and/or a shower. As shown, the occupancy compartment 11 may include a toilet 20, faucet 27, and sink 28 connected to a water supply and drain system. Toilet 20 and faucet 27 are supplied water from fresh water tanks 32 and 34. In the depicted embodiment, the fresh water tanks 32 and 34 are interconnected by connection hose 80 so that equal water level is maintained in both tanks. Pump 82 is connected to fresh water tank 34 and draws therefrom to supply water at a pressure to the faucet 27 through sink supply hose 73 and to the toilet 20 through toilet supply hose 74. In other embodiments, the system may be configured such that fresh water tanks 32 and 34 each supply one of the toilet 20 and the faucet 27, and in such embodiment each fresh water tank 32 and 34 may have a pump. In various embodiments, the pump 82 may also supply water from fresh water tank 34 to an area outside of the occupancy compartment 11. In the depicted embodiment, pump 82 pumps water to the exterior sink 18 (FIG. 10) via supply hose 89.

Figure 9:
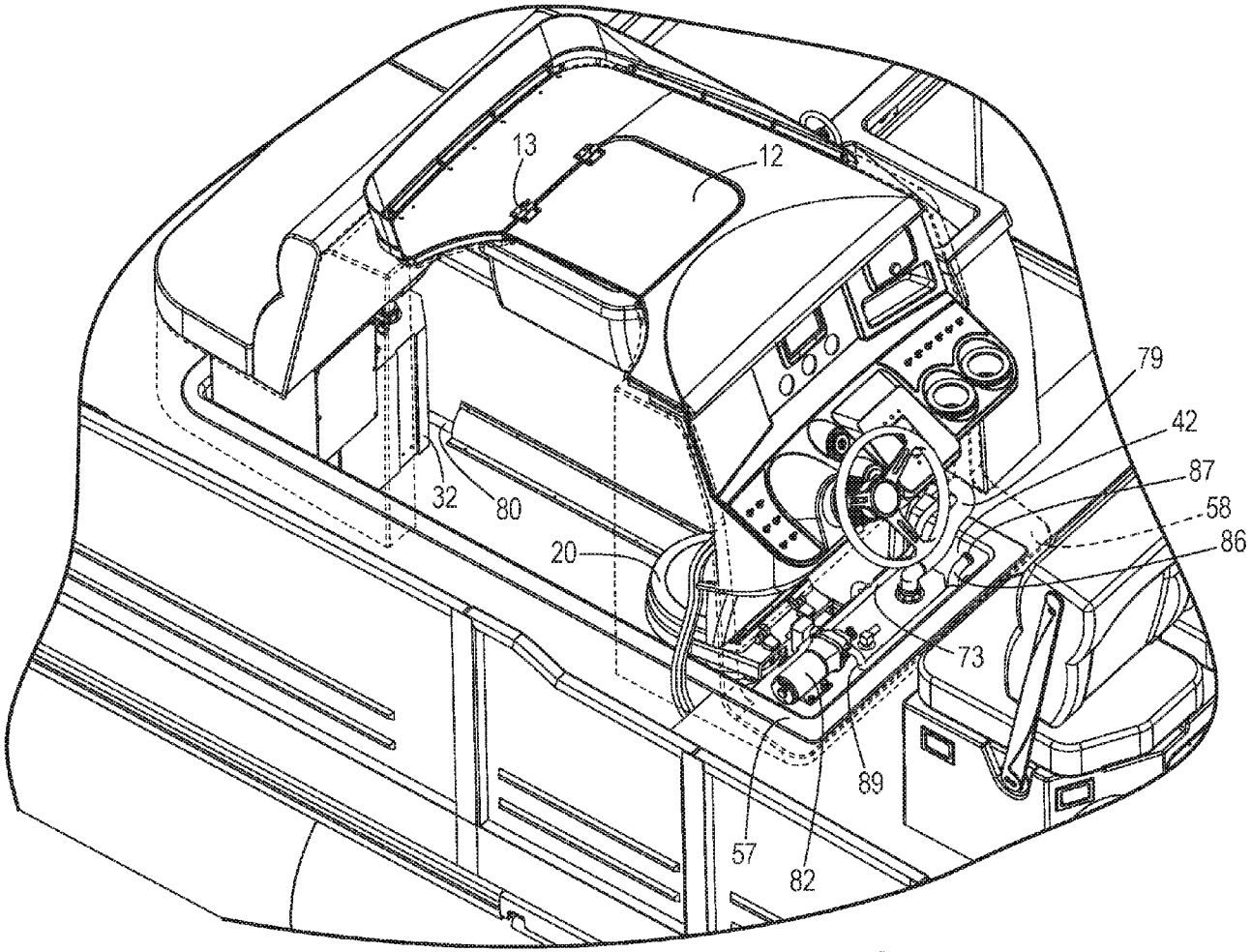
FIG. 9 depicts a perspective view through the upper liner, which is shown in translucent to allow depiction of the pump and plumbing within the exemplary occupancy compartment.

The faucet 27 may be or include a sprayer head connected to a hose that allows the faucet 27 to serve the as a water faucet for washing over the sink and as a shower head. When the faucet is removed from its holder over the sink and used as a shower head, the water may be captured on the floor surface 44 and then drained away. The floor surface 44 may be sloped so that the water runs to a low point where a bilge pump pumps the used shower water out of the pontoon boat 1 into the surrounding water body in which the pontoon boat 1 is floating. In the depicted embodiment, bilge pump (FIG. 5) pumps the waste water that drains from the floor surface 44 and pumps it through drain hose 86 out of drain port 87 (FIG. 9), which exits the side of the center pontoon tube 3. Alternatively, the waste shower water may collect in a tank, such as waste water tank 30 below the toilet 20.

Likewise, waste water captured in the sink 28, such as when the faucet 27 is used over the sink 28, and may drain out of the pontoon boat 1 by gravity, or may be forced out drain port 87 by bilge pump 81. The sink 28 is connected to a sink drain hose 72 that leads the waste water from the sink 28 out of the pontoon boat 1. In an alternative embodiment, the sink drain hose 72 could lead to a waste water storage tank, such as waste water tank 30. The fresh water tank 32, 34 that supplies the faucet 27 may be equipped with a water heater to provide hot water. In the depicted embodiment, water heater 33 connects to the faucet 27. The water heater 33 has an internal pump to pump the hot water to the faucet 27. In various embodiments, the water heater 33 may be draw water from the fresh water tank 32 and may maintain such water at a heated temperature. For example, the water heater 33 may have a three gallon tank that it maintains at a predetermined heated temperature. In another embodiment, the fresh water tank 32 may be a heated tank with a water heater, and all of the fresh water in the fresh water tank 32 may be heated. In another embodiment, the water heater 33 may be a just-in-time heater that only heats the water as needed.

The toilet 20 in the depicted embodiment is a flushing toilet and is connected to fresh water tank 34 in order to supply the water for flushing. Water from the fresh water tank 34 is pumped by pump 82 into the bowl of the toilet 20 via toilet supply hose 74. The waste water from the toilet drains, or is flushed, into waste water tank 30 positioned beneath the toilet 20 (FIG. 5). The waste water tank 30 is drained through toilet drain hose 75 by attaching a suction pump to a drain portal 76 on the pontoon boat 1 at the end of the toilet drain hose 75. In the depicted embodiment, the drain portal 76 is accessible from the exterior starboard side of the pontoon boat 1, such as when standing on a dock next to the pontoon boat 1.

Toilet paper may be contained inside of the cabinet area behind cabinet door 25, which protects it from getting wet or unrolling from the motion of the pontoon boat 1. Counter space 24 may also be provided as depicted, which may include a recessed area to keep items in place on the counter space 24 despite the boat movement.

Providing multiple fresh water tanks may allow for positioning the tanks in order to manage weight distribution. In the depicted embodiment, fresh water tanks 32 and 34 are connected by connection hose 80 such that the water remains distributed equally between the fresh water tanks 32, 34. The fresh water tanks 32 and 34 are separated along the length of the pontoon tube 3, which distributes the weight of the water. Accordingly, the weight of the fresh water tanks 32 and 34 remains equal, which maintains balance and the center of gravity on the pontoon boat 1. The fresh water tanks 32 and 34 are filled by supplying water through fill port 77 into fill hose 84, which spits into fill hose 78 leading to fresh water tank 32 and fill hose 79 leading to fresh water tank 34.

Additionally, in embodiments where the tanks are not connected, the separate tank arrangement may allow for providing a separated and targeted water system, such as to deliver potable water to the faucet 27 and non-potable water to the toilet 20, or to deliver heated water to the faucet 27. In one alternative embodiment, waste water from the sink could drain into the toilet water supply and used to flush the toilet.

In the depicted embodiments of FIGS. 1-8, the occupancy compartment 11 is situated in the lateral middle of the pontoon boat 1 above the center pontoon tube 3. In embodiments wherein the occupancy compartment 11 is provided with water tanks and bathroom facilities, as disclosed in certain embodiments herein, those facilities add significant weight and their positioning can influence the balance and center of gravity of the pontoon boat 1. Accordingly, the inventors' design has been developed to distribute the weight of the occupancy compartment 11 and associated componentry in a way that avoids adversely affecting the center of gravity or center of turn of the pontoon boat 1. In other embodiments, the occupancy compartment 11 may be situated above and extend into a pontoon tube on the port or starboard sides of the pontoon boat 1, such as to utilize the port pontoon tube 2 or the starboard pontoon tube 4. In such embodiments, weight may not be an issue if the occupancy compartment does not contain heavy componentry, such as water tanks. In certain embodiments, a counterweight or componentry may need to be provided on the opposite side of the pontoon boat 1 from the occupancy compartment 11 in order to balance the weight, such as a counterweight on or within the opposite pontoon tube 2, 4 from the one containing the occupancy compartment 11. Likewise, forward or rear balancing weight may be required for weight balance in certain embodiments, such as where the occupancy compartment 11 is positioned in a forward or rearward portion of one of the pontoon tubes 2-4.

The occupancy compartment 11 may be configured with hatch 12, which may be openable to allow fresh air to circulate in the occupancy compartment 11. Additionally, opening the hatch 12 allows for extra head room. The occupancy compartment 11 of the exemplary embodiment is approximately 60 inches in vertical height at the location of the hatch 12, and thus opening the hatch 12 may provide much needed head room. For example, the hatch 12 may be hinged, such as by hinges 13, to the top portion of the upper liner 58, and may open completely to a position 180 degrees from the closed position. The hatch 12 may be transparent to allow natural light to illuminate the occupancy compartment 11.

Figure 10:
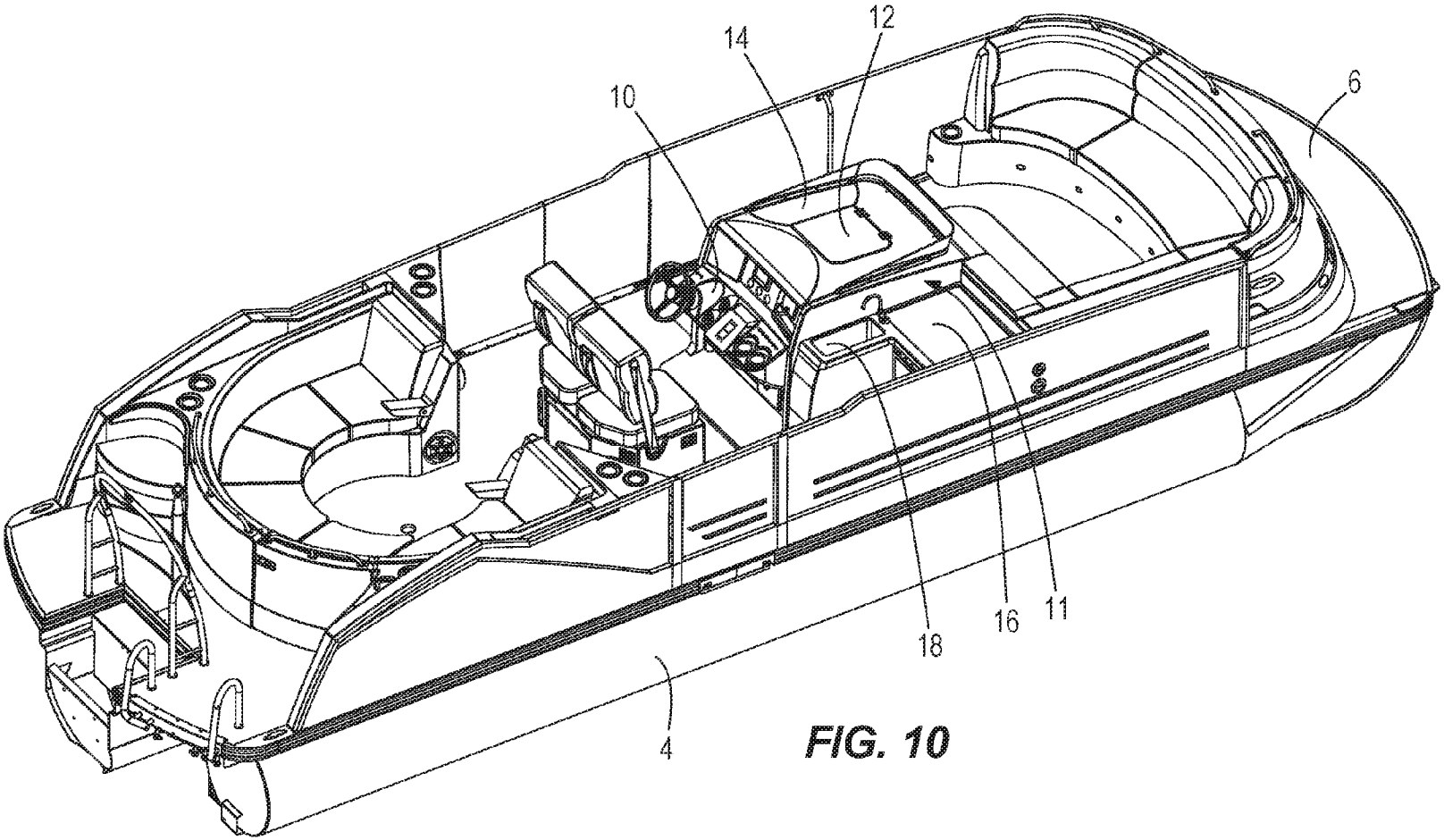
FIG. 10 is a perspective view of another embodiment of a pontoon boat having an occupancy compartment.

As shown in FIG. 10, the pontoon boat 1 may also have an exterior sink 18 and counter area 16. The space beneath the counter area 16 may be for a refrigerator, for storage space accessible from the platform 6, or storage or other space connected to the occupancy compartment 11.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An occupancy compartment in a pontoon tube of a pontoon boat, the occupancy compartment comprising:

an upper portion extending vertically above a platform of the pontoon boat, the upper portion including a ceiling;

a lower portion extending vertically below the platform and into the pontoon tube of the pontoon boat, the lower portion including a floor surface;

a metal cavity connecting the occupancy compartment within the pontoon tube, wherein the metal cavity is positioned within a hollow of the pontoon tube to create a sealed cavity surrounding at least some of the lower portion;

a liner that fits within the metal cavity to form the lower portion;

an entrance in the upper portion that permits an occupant to enter and exit the occupancy compartment;

at least one of a toilet, a sink, and a shower; and at least two fresh water tanks within the occupancy compartment connected to at least one supply hose that delivers water to the at least one of the toilet, the sink, and the shower; wherein the two fresh water tanks are longitudinally separated within the occupancy compartment and are connected together with a connection hose such that the water remains equally distributed between each of the two fresh water tanks.

2. The occupancy compartment of claim 1, wherein the liner includes a lower liner that fits within the metal cavity and forms the lower portion of the occupancy compartment and an upper liner that connects to the lower liner and forms the upper portion of the occupancy compartment.

3. The occupancy compartment of claim 1, further comprising:

at least one waste water tank that receives waste water from the at least one of the toilet, the sink, and the shower; and a drain port connected to the waste water tank by a drain hose and configured to allow connection of a suction pump to remove waste water from the waste water tank.

4. The occupancy compartment of claim 1, wherein one of the two fresh water tanks is positioned adjacent to a front side wall of the occupancy compartment and another of the at least two fresh water tanks is positioned adjacent to a rear side wall of the occupancy compartment.

5. The occupancy compartment of claim 1, further comprising a first pump associated with a first one of the at least two fresh water tanks and a second pump associated with another one of the at least two fresh water tanks, wherein the first pump is configured to deliver fresh water to the toilet and the second pump is configured to deliver fresh water to at least one of the sink and the shower.

6. A pontoon boat comprising:

at least two pontoon tubes, wherein each of the at least two pontoon tubes is metal;

a platform supported on the at least two pontoon tubes;

wherein the pontoon tubes have a length oriented along a longitudinal axis and are separated along a horizontal axis, and wherein the platform is vertically above the at least two pontoon tubes;

an occupancy compartment capable of containing at least one occupant, the occupancy compartment having:

a length extending along the longitudinal axis between a front side wall and a rear side wall;

a width extending along the horizontal axis between a port side wall and a rear side wall;

an upper portion extending vertically above the platform, the upper portion including a ceiling;

a lower portion extending vertically below the platform and into one of the at least two pontoon tubes, the lower portion including a floor surface for supporting the occupant;

an entrance in the upper portion that permits the occupant to enter and exit the occupancy compartment;

a metal cavity supporting the occupancy compartment, wherein the metal cavity is welded to the respective pontoon tube creating a sealed cavity within the pontoon tube and surrounding at least a portion of the lower portion of the occupancy compartment;

a lower liner that fits within the metal cavity and forms the lower portion of the occupancy compartment; and an upper liner that connects to the lower liner and forms the upper portion of the occupancy compartment.

7. The pontoon boat of claim 6, further comprising at least one divider within the pontoon tube confining the sealed cavity to a portion of the respective pontoon tube.

8. The pontoon boat of claim 7, further comprising at least a first divider enclosing a cross section of the pontoon tube in front of the metal cavity and a second divider enclosing a cross section of the pontoon tube to the rear of the metal cavity, wherein the metal cavity occupies a center portion along the length of the respective pontoon.

9. The pontoon boat of claim 6, wherein the entrance is a hinged door on the port side wall or the starboard side wall of the upper liner.

10. The pontoon boat of claim 9, wherein a helm of the pontoon boat is connected to an exterior rear side of the upper liner.

11. The pontoon boat of claim 9, wherein an exterior front side of the upper liner forms a seat.

12. The pontoon boat of claim 6, further comprising:

at least one of a toilet, a sink, and a shower within the occupancy compartment; and at least one fresh water tank in the occupancy compartment connected to at least one supply hose that delivers water to the at least one of the toilet, the sink, and the shower within the occupancy compartment.

13. The pontoon boat of claim 12, further comprising at least two fresh water tanks in the occupancy compartment connected together with a connection hose such that the water remains equally distributed between each of the at least two fresh water tanks, wherein the at least two fresh water tanks are separated with respect to the longitudinal axis to distribute weight along the length of the pontoon tube.

14. The pontoon boat of claim 12, further comprising at least one drain hose that drains waste water from the at least one of the toilet, the sink, and the shower out of the occupancy compartment.

15. The pontoon boat of claim 6, further comprising:

at least a starboard pontoon tube and a port pontoon tube, wherein the occupancy compartment is in one of the starboard pontoon tube or port pontoon tube; and a counterweight in the opposite one of the starboard pontoon tube or the port pontoon tube not occupied by the occupancy compartment.

16. The pontoon boat of claim 6, further comprising one or more brackets connecting the pontoon tube containing the occupancy compartment to the platform, wherein the one or more brackets are connected to the pontoon tube proximal to the occupancy compartment and provide weight bearing support for the occupancy compartment.

17. The pontoon boat of claim 6, wherein the lower liner and the upper liner connect together at a joint on or above the platform of the pontoon boat.

18. An occupancy compartment in a pontoon tube of a pontoon boat, the occupancy compartment comprising:

an upper portion extending vertically above a platform of the pontoon boat, the upper portion including a ceiling;

a lower portion extending vertically below the platform and into the pontoon tube of the pontoon boat, the lower portion including a floor surface;

a metal cavity connecting the occupancy compartment within the pontoon tube, wherein the metal cavity is positioned within a hollow of the pontoon tube to create a sealed cavity surrounding at least some of the lower portion;

a liner that fits within the metal cavity to form the lower portion, wherein the liner includes a lower liner that fits within the metal cavity and forms the lower portion of the occupancy compartment and an upper liner that connects to the lower liner and forms the upper portion of the occupancy compartment; and an entrance in the upper portion that permits an occupant to enter and exit the occupancy compartment.

19. The occupancy compartment of claim 18, wherein the lower liner and the upper liner connect together at a joint on or above the platform of the pontoon boat.

20. The occupancy compartment of claim 18, wherein the occupancy compartment is in a center pontoon tube of the pontoon boat.

* * * * *